US005816341A

United States Patent [19]

Bone et al.

[11] Patent Number: 5,816,341

[45] Date of Patent: Oct. 6, 1998

[54] HAMMER MECHANISM

[75] Inventors: Daniel Bone; Andrew Walker, both of Durham, United Kingdom

[73] Assignee: Black & Decker Inc., Newark, Del.

[21] Appl. No.: 752,095

[22] Filed: Nov. 20, 1996

[30] Foreign Application Priority Data

Nov. 27, 1995 [GB] United Kingdom ..... 9524180

[51] Int. Cl.[6] ..... B25D 11/04

[52] U.S. Cl. ..... 173/48; 173/114; 173/201; 173/122

[58] Field of Search ..... 173/48, 114, 200, 173/201, 204, 118, 117, 122

[56] References Cited

U.S. PATENT DOCUMENTS

| | | | |
|---|---|---|---|
| 3,847,229 | 11/1974 | Wanner et al. | 173/48 |
| 4,014,392 | 3/1977 | Ross . | |
| 4,750,567 | 6/1988 | Grossmann et al. | 173/201 |
| 4,895,212 | 1/1990 | Wache et al. | 173/48 |
| 5,320,177 | 6/1994 | Shibata et al. | 173/201 |
| 5,435,397 | 7/1995 | Demuth | 173/201 |

FOREIGN PATENT DOCUMENTS

| | | |
|---|---|---|
| 2702195 | 7/1978 | Germany . |
| 3804026 | 8/1989 | Germany . |

*Primary Examiner*—Scott A. Smith
*Attorney, Agent, or Firm*—Bruce S. Shapiro; Dennis A. Dearing; John D. Del Ponti

[57] ABSTRACT

A hammer mechanism (14) for a rotary drill (10) comprises a hollow piston (18), a drive (15,26) for effecting reciprocating motion of the piston (18) towards and away from an end portion (35) of a rotatable output spindle (13) of the drill (10) and a ram (21) adapted to slidably locate in a hollow portion of the piston (18). In use, reciprocating movement of the piston (18) is transferred to the ram (21) and the ram (21) periodically strikes the end portion (35) of the output spindle (13), thereby providing the hammer action of the drill. The hammer mechanism (14) also comprises a plurality of guide pins (27,28) fixed in position relative to a housing portion (11) of the drill (10), the piston (18) being provided with a plurality of guide cylinders (23,24) each one of which is adapted to cooperate with a corresponding one of the guide pins (27,27) so as to guide the reciprocating motion of the piston (18).

8 Claims, 3 Drawing Sheets

HAMMER MECHANISM

BACKGROUND OF THE INVENTION

The present invention relates to a hammer mechanism for use with a rotary drill.

Many hammer mechanisms are known in the prior art. One such mechanism comprises a cylinder with a piston slidably mounted in one end and a ram slidably mounted in the other. In use, reciprocating motion of the piston is transferred to the ram, by means of an air spring located intermediate the piston and ram, and the ram strikes an output spindle of a drill, thereby providing the hammer action of the drill.

It is also known from DE-A-3 804 026 to provide a hammer mechanism which comprises a cylindrical sleeve having a hollow piston slidably accommodated therein, a ram adapted to locate slidably in a hollow portion of the piston and drive means for generating reciprocating movement of the piston.

Although the prior art hammer mechanisms described above function satisfactorily, the present invention aims to provide an alternative novel mechanism which can result in certain advantages.

SUMMARY OF THE INVENTION

According to the present invention, there is provided a hammer mechanism for a rotary drill, the hammer mechanism comprising a hollow piston, drive means for effecting reciprocating motion of the piston towards and away from an end portion of a rotatable output spindle of the drill, a ram slidably received in a hollow portion of the piston so that, in use, reciprocating motion of the piston is transferred to the ram and the ram periodically strikes the end portion of the output spindle, and at least one guide pin for fixing in position relative to a housing portion of the drill, the piston being provided with a guide cylinder adapted to cooperate with the guide pin so as to guide the reciprocating motion of the piston.

The present invention, therefore, does not require a sleeve for accommodating the hollow piston and, consequently, the bulk of the hammer mechanism and the frictional forces acting against reciprocating motion of the piston are reduced.

In accordance with a preferred embodiment of the invention the hollow portion of the piston communicates with the guide cylinder via a first aperture and the guide pin is provided with a portion of reduced cross sectional area which allow ingress and egress of air into and out of the hollow portion of the piston when the first aperture and the portion of reduced cross sectional area are aligned one with the other.

Preferably, the guide cylinder is provided with a second aperture in a diametrically opposed location to the first aperture.

In one embodiment, the portion of reduced cross sectional area is a necked region of the guide pin.

In an alternative embodiment, the portion of the guide pin comprises a flattened region. If so, the flattened region preferably extends to an end of the guide pin.

Additionally, the guide pin may be rotatable from an open position, which allows ingress and egress of air into and out of the hollow portion of the cylinder, to a closed position, which prevents ingress and egress of air and thereby substantially inhibits the hammer action of the drill.

Preferably, the ram is provided with a resilient ring so as to provide a hermetic seal between the ram and the hollow portion of the piston.

Preferably, the mechanism comprises two guide cylinders and two corresponding guide pins.

BRIEF DESCRIPTION OF THE DRAWING

A specific embodiment of the present invention is now described, by way of example only, with reference to the accompanying drawings, in which.

DESCRIPTION OF THE PREFERRED EMBODIMENT

Figure 1:
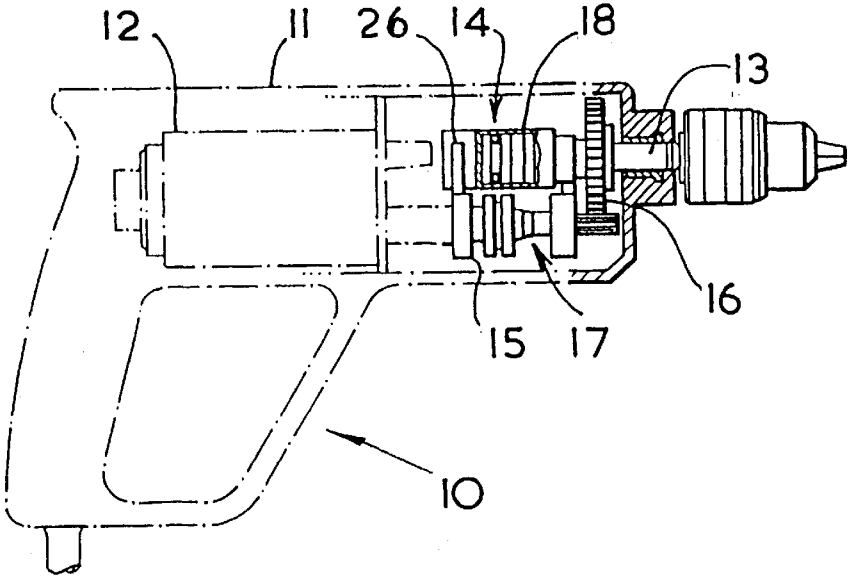
FIG. 1 is a diagrammatic cross sectional view of a drill including a hammer mechanism in accordance with the present invention.

Referring to the drawings, there is shown a hammer drill 10 having a housing 11, a motor 12, an output spindle 13 and a hammer mechanism 14. Affixed to the hammer mechanism 14 is a wobble plate 15 which is driven by the motor 12, the wobble plate 15 in turn driving the hammer mechanism 14. The motor 12 also causes the output spindle 13 to rotate about its central longitudinal axis by virtue of output gear 16 and drive linkage 17.

Figure 2:
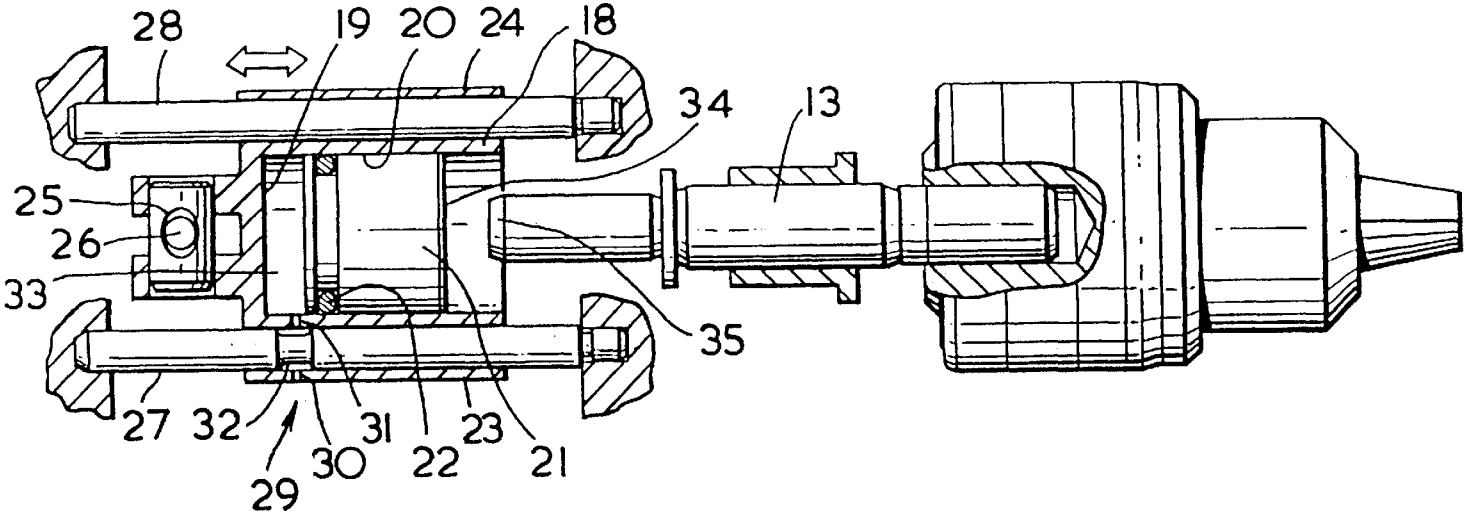
FIG. 2 is a diagrammatic representation, partly in cross section, of the hammer mechanism.

The hammer mechanism 14, which is shown more clearly in FIG. 2, comprises a hollow piston 18 having an inner circular surface 19 and an inner cylindrical surface 20. Accommodated in the piston 18 is a cylindrical ram 21 of slightly smaller diameter than the inner cylindrical surface 20 of the hollow piston 18, the ram 21 being provided with an "O" ring 22 so as to provide a hermetic sliding seal between the inner cylindrical surface 20 and the ram 21.

The piston 18 also comprises first and second cylindrical guides, 23 and 24 respectively, extending in a direction parallel to a longitudinal axis of the piston 18, and a socket 25 which is adapted to receive a drive pin 26 of the wobble plate 15.

The hammer mechanism 14 also includes first and second guide pins, 27 and 28 respectively, which are affixed at their ends to the housing 11 of the drill 10. The first and second cylinders 23, 24 are located on the corresponding first and second guide pins 27 and 28 and the arrangement is such that the piston 18 can slide on the guide pins 27 and 28 in a direction shown by the double arrow in FIG. 2.

The hammer mechanism 14 further comprises a valve 29 comprising first and second apertures 30, 31 formed in the first cylindrical guide 23 and a necked portion 32 formed in the first guide pin 27, the locations of the apertures 30, 31 and the necked portion 32 being such that, when the apertures 30, 31 and the necked portion 32 are aligned, air is allowed to flow into and out of a cavity 33 defined by the circular surface 19, the cylindrical surface 20 and the ram 21. In this way, pressure inside the cavity 33 is regulated. Further, by appropriate location of the apertures 30, 31 in the first cylindrical guide 23, and the. location of the necked portion 32 on the first guide pin 27, the desired pressure regulation may be achieved.

In operation, the piston 18 is driven by the drive pin 26 of the wobble plate 15 such that piston 18 reciprocates in a direction towards and away from the output spindle 13. As a result of the piston 18 moving towards the output spindle 13, an impact surface 34 of the ram 21 strikes against an end portion 35 of the spindle 13, thereby providing the hammer action of the drill 10.

Figure 3A:
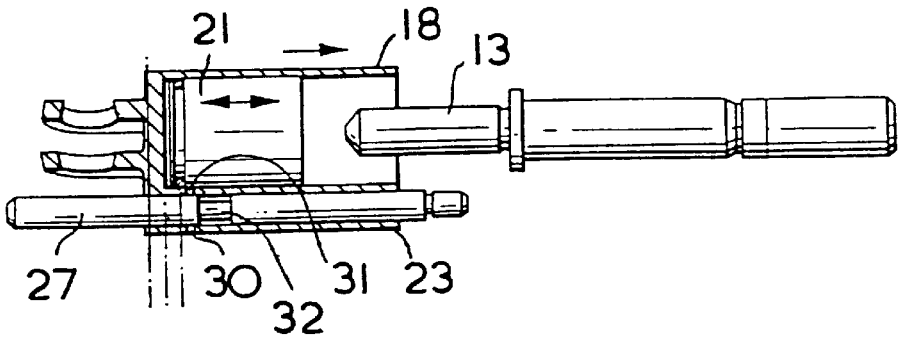
FIGS. 3*a* to 3*e* are diagrammatic representations showing locations of components of the hammer mechanism relative to each other at different stages of the operating procedure of the mechanism.

The operation of the hammer mechanism 14 is shown in more detail in FIGS. 3*a* to 3*e*, and the operating sequence is as follows:

1 As shown in FIG. 3*a*, the hollow piston 18 is in mid-stroke and the ram 21 compresses air trapped in the cavity 33 to a maximum. The compressed air then acts like a spring and propels the ram 21 towards the output spindle 13.

Figure 3B:
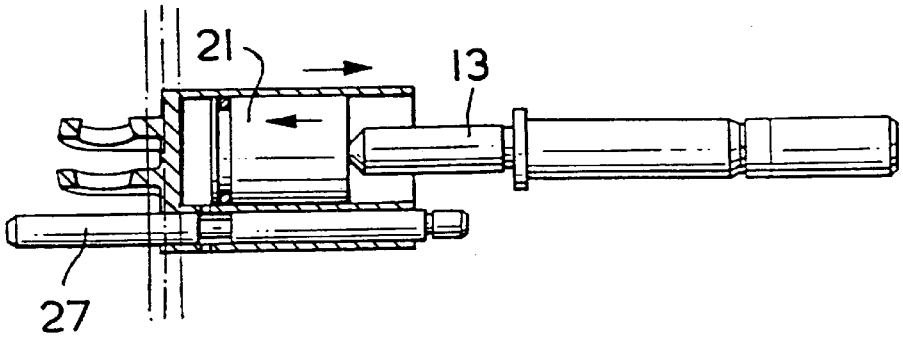

2 As shown in FIG. 3*b*, the ram 21 out-accelerates the forward stroke of the piston 18 due to the air spring, and the ram 21 impacts against the output spindle 13. The valve 29 is open for a short time and air is drawn into the cavity 33 through the apertures 30, 31 and the necked portion 32.

Figure 3C:
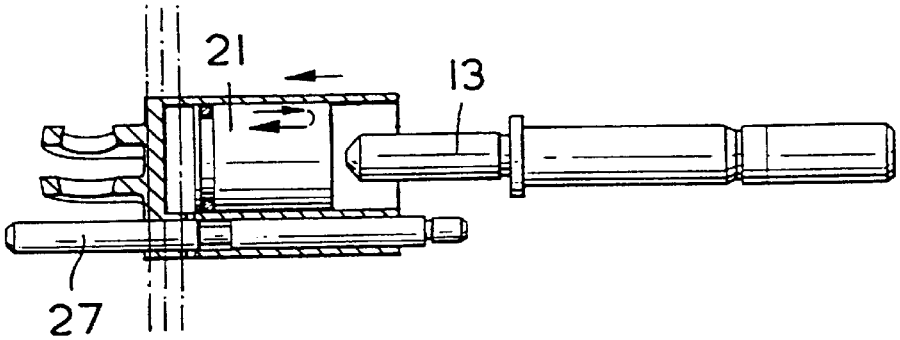

3 As shown in FIG. 3*c*, the valve 30 then closes and both the ram 21 and piston 18 move in the same direction, the piston 18 moving faster than the ram 21.

Figure 3D:
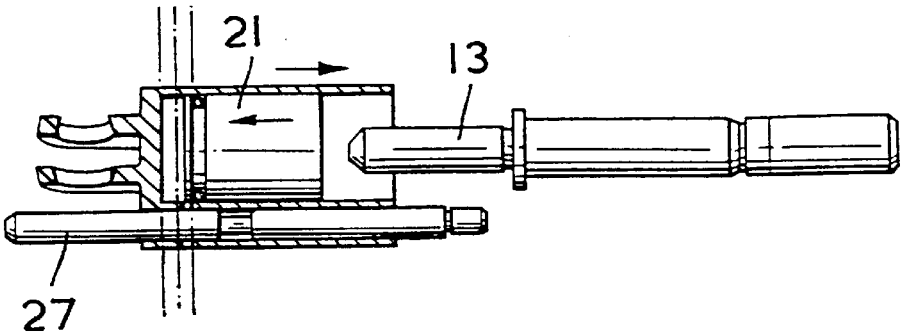

4 As shown in FIG. 3*d*, the piston 18 is at the end of its stroke and the ram 21 once again begins to compress the trapped air. The piston 18 starts to reverse direction, increasing the compression action which will initiate the air spring effect.

Figure 3E:
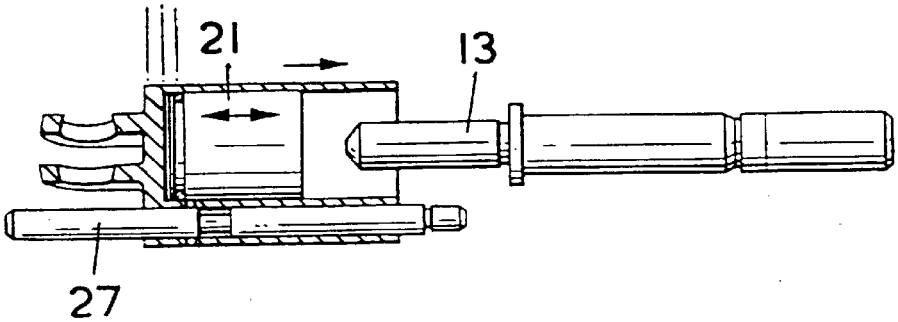

5 As shown in FIG. 3*e*, the sequence then repeats and the ram 21 compresses air trapped in the cavity 33 to a maximum.

Figure 4A:
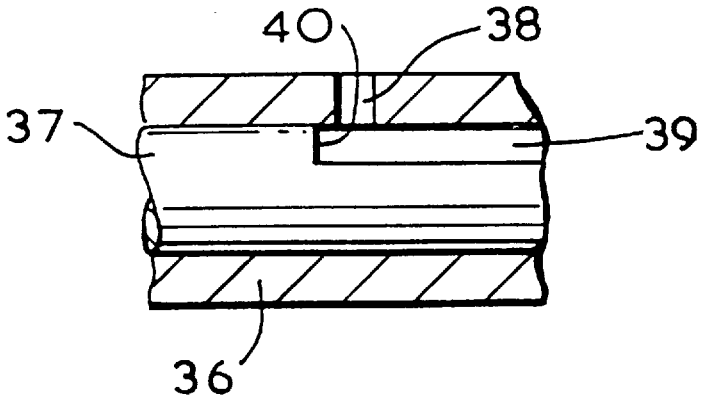
FIG. 4*a*, 4*b*, and 4*c* show an alternative configuration for a guide pin of the hammer mechanism.
Figure 4B:
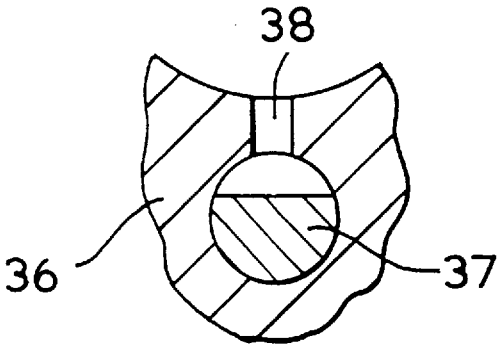

An alternative construction of the first guide pin 27 is shown in FIG. 4. In this embodiment, the cylindrical guide 36 has a single aperture 38 and the guide pin 37 5 includes a flattened region 39 which extends from a surface 40 to an end of the guide pin 37. With such an arrangement, air is allowed to pass through the aperture 38 when the flattened region 39 is aligned with the aperture, as is shown in FIGS. 4*a* and 4*b*.

Figure 4C:
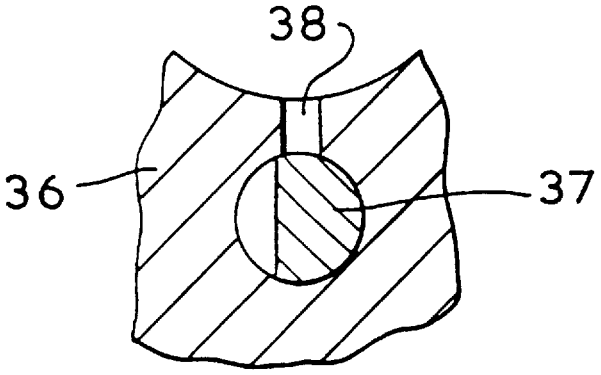

The guide pin 37 is mounted on the housing 11 so that the guide pin 37 can be rotated about its longitudinal axis, thereby effecting opening and closing of the aperture 38. When the aperture is in an open condition, as shown in FIG. 4*b*, the hammer mechanism operates in accordance with the sequence shown in FIG. 3. However, when the guide pin 37 is in a closed condition, as shown in FIG. 4*c*, air flow between the atmosphere and the cavity 34 is prevented and the hammer action of the drill is substantially inhibited.

It will be appreciated that the hollow piston 18 could be provided with more than two cylindrical guides and supported on a corresponding number of guide pins.

It will also be appreciated that, by providing a cylindrical guide on a guide pin as shown in FIG. 4, controllability of the hammer action may be achieved.

It will of course be understood that the present invention has been described above purely by way of example, and that modifications of detail can be made within the scope of the invention.

We claim:

1. A hammer mechanism for a rotary drill, the hammer mechanism comprising a hollow piston, drive means for effecting reciprocating motion of the piston towards and away from an end portion of a rotatable output spindle of the drill, a ram slidably received in a hollow portion of the piston so that, in use, reciprocating motion of the piston is transferred to the ram and the ram periodically strikes the end portion of the output spindle, and at least one guide pin for fixing position of said piston relative to a housing portion of the drill, the piston being provided with a guide cylinder adapted to cooperate with the at least one guide pin so as to guide the reciprocating motion of the piston and the hollow portion of the piston communicates with the guide cylinder via a first aperture and the at least one guide pin is provided with a portion of a reduced cross-sectional area which allows ingress and egress of air into and out of the hollow portion of the piston when the first aperture and the said portion of reduced cross-sectional area are aligned one with the other.

2. A hammer mechanism as claimed in claim 1, wherein the guide cylinder is provided with a second aperture in a diametrically opposed location to the first aperture.

3. A hammer mechanism as claimed in claim 2, wherein the at least one guide pin comprises a necked portion.

4. A hammer mechanism as claimed in claim 1, wherein the at least one guide pin includes a flattened region.

5. A hammer mechanism as claimed in claim 4, wherein the flattened region extends to an end of the at least one guide pin.

6. A hammer mechanism as claimed in claim 5, wherein the at least one guide pin is rotatable from an open position, which allows ingress and egress of air into and out of the hollow portion of the piston, to a closed position, which prevents said ingress and egress of air and thereby substantially inhibits the hammer action of the drill.

7. A hammer mechanism as claimed in claim 1, wherein the ram is provided with a resilient ring so as to provide a hermetic seal between the ram and the hollow portion of the piston.

8. A hammer mechanism as claimed in claim 1, wherein the mechanism comprises a second guide cylinder diametrically opposing the first guide cylinder and a second guide pin corresponding to the second guide cylinder.

* * * * *